US007219916B2

(12) United States Patent
Olson

(10) Patent No.: US 7,219,916 B2
(45) Date of Patent: May 22, 2007

(54) SNOWBOARD

(76) Inventor: Mark A. Olson, 96 N. 400 East, Price, UT (US) 84501

( * ) Notice: Subject to any disclaimer, the term of this patent is extended or adjusted under 35 U.S.C. 154(b) by 0 days.

(21) Appl. No.: 10/960,141

(22) Filed: Oct. 7, 2004

(65) Prior Publication Data

US 2006/0082083 A1 Apr. 20, 2006

(51) Int. Cl.
*A63C 5/04* (2006.01)

(52) U.S. Cl. ..... 280/609; 280/608; 280/14.21

(58) Field of Classification Search ..... 280/609, 280/608, 600, 601, 14.21
See application file for complete search history.

(56) References Cited

U.S. PATENT DOCUMENTS

| | | | | |
|---|---|---|---|---|
| 3,099,025 | A * | 7/1963 | Merkley et al. | 441/68 |
| 3,761,980 | A | 10/1973 | Silverstein | |
| 4,305,603 | A * | 12/1981 | Muller et al. | 280/607 |
| 4,608,023 | A | 8/1986 | Williams | |
| 4,666,171 | A | 5/1987 | Sellers | |
| 4,752,082 | A | 6/1988 | Sevington | |
| 4,974,868 | A | 12/1990 | Morris | |
| 5,135,249 | A | 8/1992 | Morris | |
| 5,301,965 | A | 4/1994 | Floreani | |
| 5,320,378 | A | 6/1994 | Wiig | |
| 5,462,304 | A * | 10/1995 | Nyman | 280/609 |
| 6,224,085 | B1 * | 5/2001 | Cruz | 280/609 |
| 6,276,699 | B1 * | 8/2001 | Simmons et al. | 280/28 |
| 6,352,268 | B1 * | 3/2002 | Peart | 280/14.21 |
| 6,533,625 | B1 | 3/2003 | Taylor | |
| 6,663,137 | B2 | 12/2003 | Karlsen | |
| 6,834,867 | B2 * | 12/2004 | Smith | 280/14.21 |
| 6,935,909 | B2 * | 8/2005 | Mann | 441/65 |
| 2001/0019198 | A1 * | 9/2001 | Wolf | 280/609 |
| 2002/0121765 | A1 * | 9/2002 | Wolf | 280/609 |
| 2003/0151215 | A1 * | 8/2003 | Stief et al. | 280/14.21 |
| 2004/0032113 | A1 * | 2/2004 | Rancon et al. | 280/609 |
| 2004/0262885 | A1 * | 12/2004 | Wilson | 280/609 |

FOREIGN PATENT DOCUMENTS

| | | |
|---|---|---|
| EP | 0 778 053 A2 | 6/1997 |
| EP | 1 058 573 B1 | 6/2003 |

* cited by examiner

*Primary Examiner*—J. Allen Shriver
(74) *Attorney, Agent, or Firm*—Morriss O'Bryant Compagni, P.C.

(57) ABSTRACT

A snowboard has elongate runners integrally formed with the bottom surface of the snowboard to increase the downhill speed characteristics of the snowboard. The runners define a longitudinally extending channel thereinbetween. The cross-sectional thickness of the snowboard is thicker at the runners and becomes thinner along the channel to increase the stiffness of the snowboard without significantly increasing the weight of the snowboard.

36 Claims, 7 Drawing Sheets

(SECTION A - A)

(SECTION A - A)

SNOWBOARD

BACKGROUND

1. Field of the Invention

The present invention relates generally to a snowboard, and more specifically, to a snowboard that is configured to increase downhill speed and stability by decreasing the bottom surface area of the snowboard that is in contact with the surface of the snow and that has increased longitudinal and lateral stiffness.

2. Description of the Art

A typical snowboard is comprised of an elongate, flat board with the forward and rear ends upwardly curved. In most boards, the bottom surface is flat so as to provide maximum contact between the board and the snow surface. Most snowboards are comprised of a layered, laminated structure that is designed to provide rigidity with limited flexibility depending upon the use of the snowboard, whether designed primarily for speed or maneuverability.

A typical snowboard is comprised of a gliding surface having a sole for gliding bordered by metal edges. A lower reinforcing layer, either fibrous or metallic, overlays the sole to which a core is attached. An upper reinforcing layer, either fibrous or metallic, is laminated to the core and covered by a protecting and decoration-supporting foil, made either in the form of a shell and therefore constituting the top and sides of the board, or existing solely on the upper face of the board.

Wood core "cap" construction, a technique which wraps a wooden core in fiberglass and covers the top and sides with a one-piece cap for snappy response, is widespread in the snowboard industry. Certain other designs (e.g., Morrow's 3D Revert freestyle snowboard) have rods which impart progressive flexibility and strength to the snowboard, while others (e.g., Killer Loop's freestyle Trick snowboards) use a modified "fiber tube" cap construction to provide for lighter weight and increased control. Traditionally, however, a laminated wood core construction with no cap has been used.

A core made of wood is relatively heavy, slightly vibrating, and of relatively low cost price. It improves the mechanical characteristics of stiffness, of resistance to deformation and of resistance to tear of the screws maintaining the bindings, as well as the characteristics of adhesion in bonding between the various layers of the snowboard. Compared to a core made of wood, a core made of synthetic foam can be lighter and more dampened, but more expensive. Such synthetic foams include fiber-reinforced polyurethane foam, polyurethane foam and acrylic foam.

It is known to wrap fiberglass (a fiber reinforced composite), around the core to provide a strong and lightweight torsion box construction for a snowboard. A sheet of woven glass (reinforcement) fiber is wetted with a binder resin and wrapped around the base core with a slight overlap, the base core being made of a lightweight wood or a synthetic foam such as polyurethane. The wetted reinforcement fiber sheet is then cured about the base core within a press, wherein heat may be applied for accelerating the curing process. During curing, the press molds the wetted fibers and base core with a desired profile while squeezing out excess resin so that the resulting cured composite is adhered to the base core without air pockets.

A variety of materials such as wood, metal and foam have been used in conjunction with fiberglass in an attempt to achieve a snowboard that is stiffer underfoot and more flexible in the tip and tail to aid in the absorption of bumps and other terrain irregularities. In many snowboards, a layer of plastic, such as P-Tex, is first molded into an appropriate shape for a snowboard. After the layer of plastic has cured, reverse graphics are printed on the plastic layer. Each longitudinal edge of the snowboard is provided with a metal edge that extends the length of the board. The metal edges are adhered to the layer of plastic. The metal edges are typically sharpened to an abrupt 90 degree angle to cut into the snow when turning and thus provide turning ability to the board.

A layer of fiberglass is applied over the surface of the plastic layer. A veneer inset is positioned within the layer of fiberglass. A stiff material such as wood, metal or foam is encapsulated with a fiberglass layer to form a core. Metal plates or inserts are inserted into the core so that bindings may be ultimately fastened to the snowboard. The snowboard is completed by applying a final resin or laminate layer that is applied over the surface of the fiberglass layer and over the edges of the fiberglass layer.

A snowboarder desires various degrees of longitudinal and torsional rigidity depending upon the snowboarding conditions and style. Longitudinal rigidity characterizes the board's ability to bend along its length. Torsional rigidity describes the ability of the board to flex and twist about its longitudinal axis. For downhill speed, a stiff snowboard is generally preferred wherein the longitudinal and torsional flexibilities are limited.

Another snowboard parameter is edging strength, which determines the ability of the board to cut and hold an edge against a slope under forces of a turn or stop. Edging strength is primarily related to the strength of the vertical composite side walls of the torsion box construction formed around the base core. In addition, while carving such a turn or stop, it is common to encounter an object with the edge of the snowboard, which object imparts a localized force to the vertical composite side wall of the torsion box core proximate the point of impact. If great enough, the localized force, which is not uniformly distributed across the snowboard, can cause a fracture in the vertical composite side wall or cause a portion of the board to break away proximate the localized force. Therefore, a strong composite is desired for providing the torsion box core with strong vertical composite side walls. However, in a conventional snowboard, the snowboard's edging strength and rigidity are both related to the strength of the composite of the torsion box core such that increasing the strength of the composite of the torsion box core for improving the board's edging strength in turn decreases the board's flexibility.

Another concern is a strength/weight compromise. In a typical snowboard having a uniform cross-section, increasing board thickness to increased board stiffness proximate the mid-section relative the nose and tail sections will also significantly increase the weight of the snowboard.

One of the problems associated with the metal edges of a snowboard is that a snowboarder can easily and unwillingly perform a maneuver commonly referred to as "catching an edge" in which upon transitioning the board from one edge to the other, the metal edge will quickly engage the snow thus sending the snowboarder to the ground. Especially for beginners, many of their injuries are a result of the board catching an edge and the snowboarder being essentially whipped to the ground. The impact of such whipping often results in broken wrists and other arm injuries.

One snowboard known in the art and referred to as the "tunnelboard" is disclosed in U.S. Pat. No. 6,224,085 to Cruz. The tunnelboard is provided with a profile that defines a longitudinally extending channel along the bottom surface of the snowboard. The cross-sectional thickness of the board, however, is generally uniform in order to maintain the flexibility of the snowboard. The tunnelboard also includes internal edges along the channel to grip the snow. The combination of the flexible board and internal edges results in a snowboard that is unstable at higher speeds and will result in more frequent edge catching as there is significantly more edging of the snowboard due to the internal edges.

Thus, it would be advantageous to provide a snowboard that is generally more torsionally and longitudinally rigid than a conventional snowboard without significant addition of weight to the snowboard. It would be a further advantage to provide a snowboard that is significantly faster than a conventional snowboard of similar size. It would also be an advantage to provide a snowboard that is generally more stable when riding and is less susceptible to edge catching than snowboards known in the art.

These and other advantages will become apparent from a reading of the following summary of the invention and description of the illustrated embodiments in accordance with the principles of the present invention.

SUMMARY OF THE INVENTION

Accordingly, a snowboard is comprised of an elongate board having a top surface, a bottom surface, a tip portion, a tail portion, a mid portion and first and second longitudinal edges. The top surface of the board being is relatively flat between the portion and the tail portion in order to support a pair of bindings for holding a pair of snowboard boots thereto. The snowboard also includes a pair of elongate runner surfaces that are integrally formed with the bottom surface of the board and that extend along a substantial length of the snowboard between the tip portion and the tail portion. Adjacent to the runner surfaces are a pair of edges that are coupled to the bottom surface of the board along the outside edge of each runner surface. The edges provide turning ability to the snowboard.

In one embodiment, the runner surfaces have a substantially consistent width substantially along their entire length. In another embodiment, the runner surfaces define an inner surface that is substantially linear, while the outside edge is curved to match the contour of the outside edge of the board.

In yet another embodiment, the snowboard according to the present invention is wider at the tip and tail portions than at a midpoint of the snowboard.

In another embodiment, a snowboard in accordance with the principles of the present invention includes first and second runner surfaces that are approximately between 0.5 inches and 2.0 inches wide.

In still another embodiment according to the present invention, the bottom surface of the snowboard defines a longitudinally extending channel that has a depth that is approximately between 0.2 inches and 1.0 inches relative to the runner surfaces.

The bottom surface of the snowboard defines a substantially smooth contour between the outer longitudinal edges of the snowboard. Thus, there is no internal edges that would otherwise make it more difficult to transition from one outside edge of the snowboard to the other.

In yet another embodiment of the snowboard of the present invention, the snowboard has a non-uniform cross-sectional thickness between the two outer edges of the snowboard. This variation in cross-sectional thickness of the snowboard significantly improves the stiffness of the snowboard and dramatically improves downhill speed performance characteristics.

A snowboard according to the present invention may be formed by providing an elongate core covered by a top layer defining a top surface, a bottom layer defining a bottom surface. A pair of longitudinal metal edges may be provided along each bottom edge of the snowboard to aid in turning of the board. A pair of elongate strips are formed to the bottom surface adjacent the outer longitudinal edges of the core. These strips define longitudinally extending runner surfaces with the strips forming a longitudinally extending channel along the bottom of the snowboard.

In one embodiment, the longitudinally extending strips are integrally formed with the core. In another embodiment, the longitudinally extending strips are attached to the bottom of the core as by laminating to form the runner surfaces.

BRIEF DESCRIPTION OF THE DRAWINGS

The foregoing summary, as well as the following detailed description of the preferred embodiments is better understood when read in conjunction with the appended drawings. For the purpose of illustrating the invention, there is shown in the drawings embodiments that illustrate what is currently considered to be the best mode for carrying out the invention, it being understood, however, that the invention is not limited to the specific methods and instruments disclosed.

DETAILED DESCRIPTION OF THE ILLUSTRATED EMBODIMENTS

Figure 1:
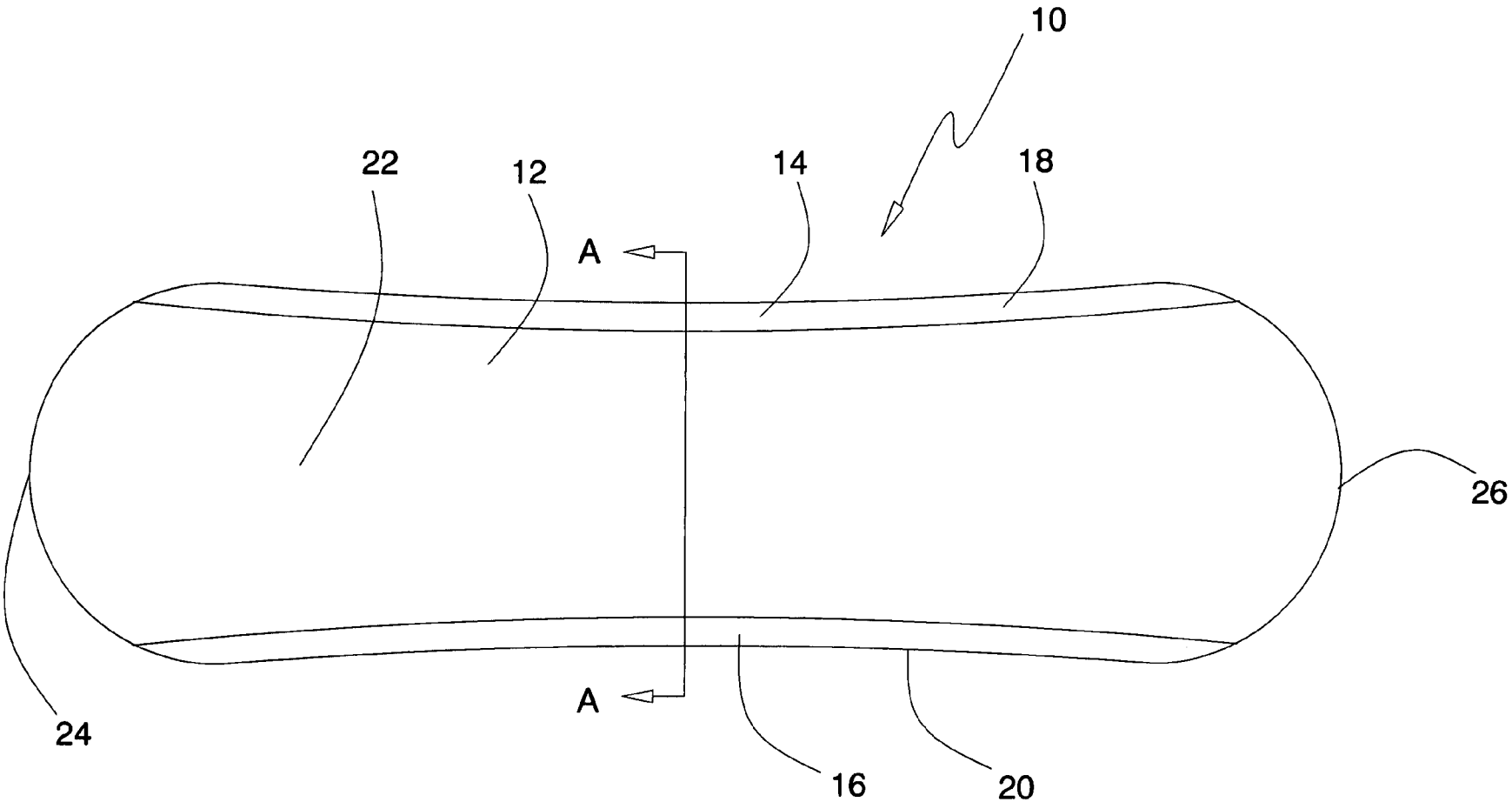
FIG. 1 is a bottom view of a first embodiment of a snowboard in accordance with the principles of the present invention.

Referring to the drawings wherein like numerals indicate like elements throughout, there is shown in FIG. 1, a bottom surface 12 of a snowboard, generally indicated at 10, in accordance with the principles of the present invention. The snowboard 10 is configured with a length to width ratio that is comparable to other snowboards known in the art. The snowboard 10 is provided with a first and second longitudinal runner surfaces 14 and 16 that are positioned along the lateral sides 18 and 20, respectively, that form the outer longitudinal edges of the snowboard 10. The runner surfaces 14 and 16 are defined by a longitudinally extending channel 22 that extends substantially along the bottom surface 12 of the snowboard 10. For a conventional length of snowboard, the runner surfaces 14 and 16 may have a width of approximately 0.5 to 2 inches or more and extend from proximate the tip portion 24 of the snowboard 10 to the tail portion 26. Moreover, as shown, the runner surfaces 14 and 16 have a substantially consistent width along their length. Thus, even though the width of the snowboard 10 may change between its two ends 24 and 26, the runner surfaces 14 and 16 maintain their width and follow the inwardly curved contour of the snowboard 10.

Figure 2:
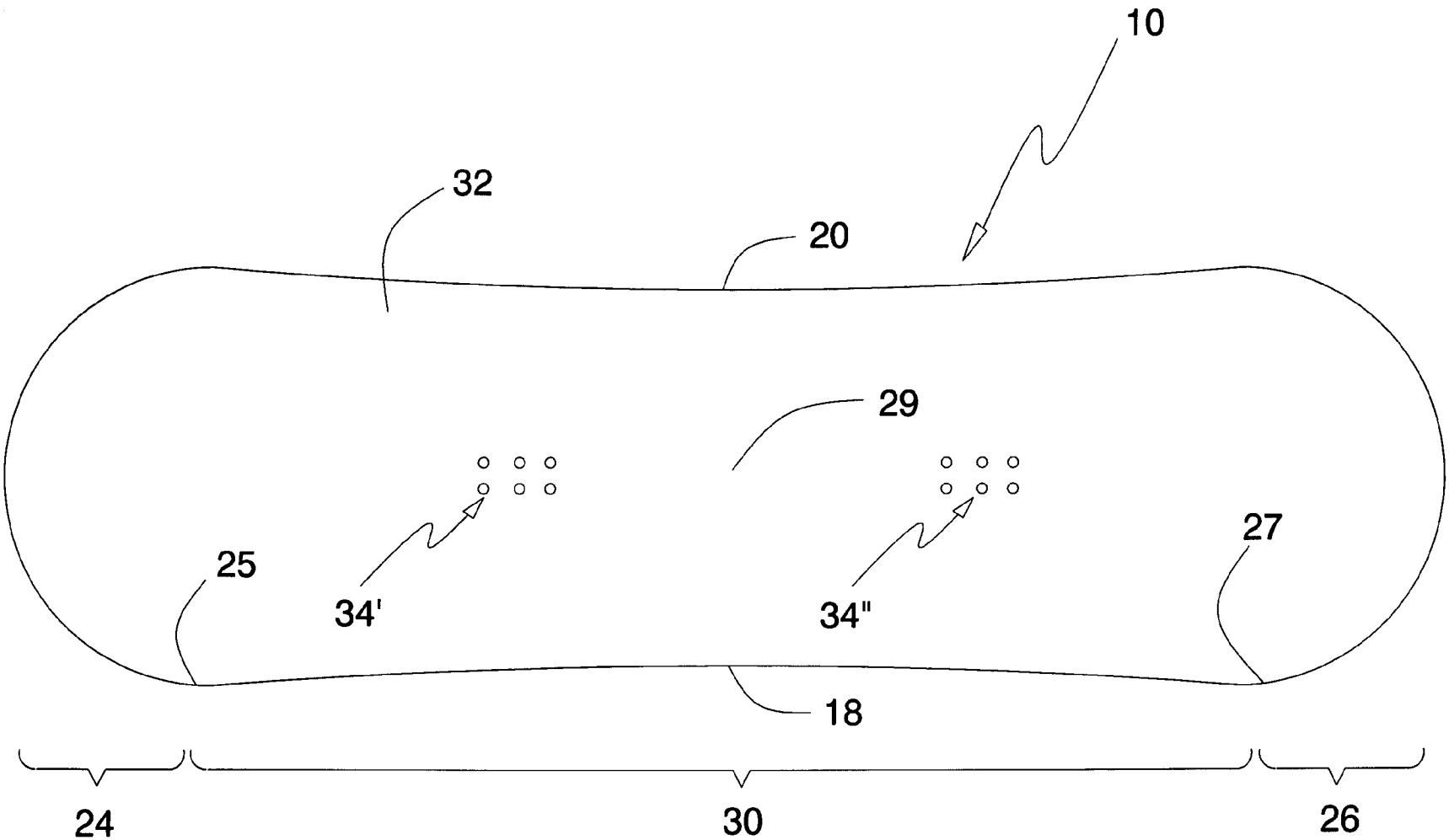
FIG. 2 is a top view of the snowboard illustrated in FIG. 1.

As further illustrated in FIG. 2, the snowboard 10 is generally comprised of three portions including a tip portion 24, a tail portion 26 and a central or mid portion 30. The top surface 32 of the snowboard 10 is substantially flat along the mid portion 30 between the tip potion 24 and the tail portion 26. With the particular snowboard 10 as illustrated, the snowboard 10 is generally wider at the transition 25 between the tip potion and the mid portion 30 and at the transition 27 between the mid portion 30 and the tail portion 26 than at a central point 29 of the mid portion 30. As such, the snowboard 10 has a somewhat hourglass shape with inwardly curved sides along its mid portion 30, which aids in turning of the snowboard 10.

Figure 3:
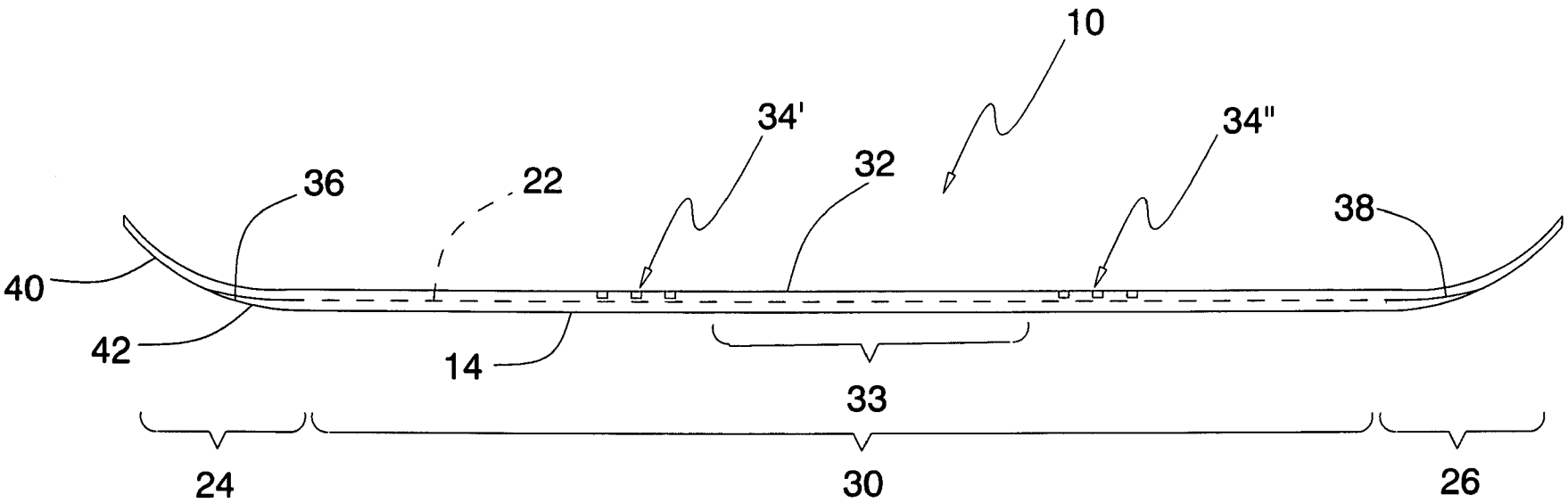
FIG. 3 is a left side view of the snowboard illustrated in FIGS. 1 and 2.

As shown in FIG. 3, the tip and tail portions 24 and 26, respectively, are curved upwardly to allow the snowboard 10 to glide over the snow in either a forward or backward direction. The binding attachments 34' and 34" are embedded in and attached to the top surface 32 of the snowboard 10 and within the mid portion 30. By providing the snowboard 10 with a substantially flat top portion, conventional boot bindings (not shown) can be used and attached to the internally threaded binding attachments generally indicated at 34' and 34". The runner surfaces, of which only runner surface 14 is visible, define longitudinally extending channel 22. The longitudinally extending channel 22 has a generally consistent depth within the mid portion 30 of the board. The ends 36 and 38 have a tapered thickness so as to curve into the tip and tail portions 24 and 26, respectively. Thus, the interface between the leading surface 40 of the tip portion 24 and the leading surface 42 of the runner 14 defines a relatively smooth transitional surface of consistent radius. It should be noted that while the thickness of the snowboard along its mid portion is illustrated as being relatively consistent along its length, it may, in reality be thicker at a central portion 33 and become thinner toward each end. This allows for greater stability in the snowboard between the binding attachments 34' and 34" while providing improved flexibility proximate the tip and tail portions 24 and 26, respectively. In addition, the snowboard 10, while being described as having a substantially flat top surface 32, may actually include a slight chamber or bow to the snowboard 10 between the tip portion 24 and the tail portion 26.

Figure 4:
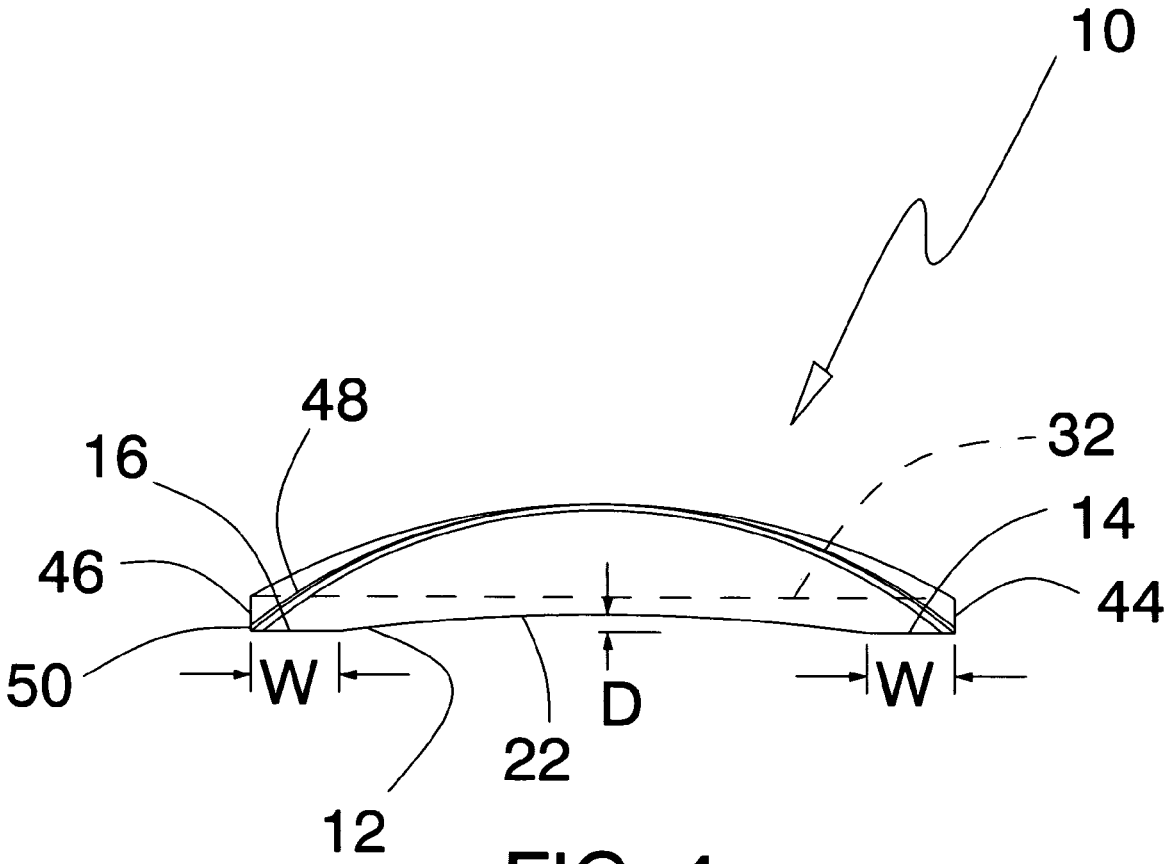
FIG. 4 is a front side view of the snowboard illustrated in FIGS. 1, 2 and 3.

Thus, as shown in FIG. 4, the longitudinally extending channel 122 is defined by the bottom surface 12 of the snowboard 10 and extends between the two runner surfaces 14 and 16. While the top surface 32 is substantially linear between the left side 44 and the right side 46, the bottom surface, and particularly the channel 22 defines an arcuate recess or channel that extends substantially the entire length of the snowboard 10. The width W of each runner surface 14 and 16 is approximately between 0.5 inches and 2.0 inches. In addition, the depth of the channel 22 need not be significant in order to achieve the benefits associated with a snowboard 10 configured in accordance with the present invention. Thus, the depth D of the channel 22 may range from approximately 0.2 inches to about one inch. The entire bottom surface 12 of the snowboard 10 provides a relatively smooth contour from the left edge 44 to the right edge 46.

A metal edge 48 is provided around the perimeter of the snowboard 10 along its lower edge 50. The metal edge 48 prevents the snowboard's lower edge 50 from becoming damaged due to impact with hard objects, such as rocks, and also to aid in turning of the snowboard 10. The metal edge 48 thus extends along an outside edge of each runner surface 14 and 16 and defines an abrupt angle to cut into the snow when performing a turning maneuver. Thus, there are no other edging surfaces needed for turning the snowboard of the present invention and the smooth contour of the bottom surface 12 aids in smooth transitioning from one runner surface 14 to the other.

Figure 5:
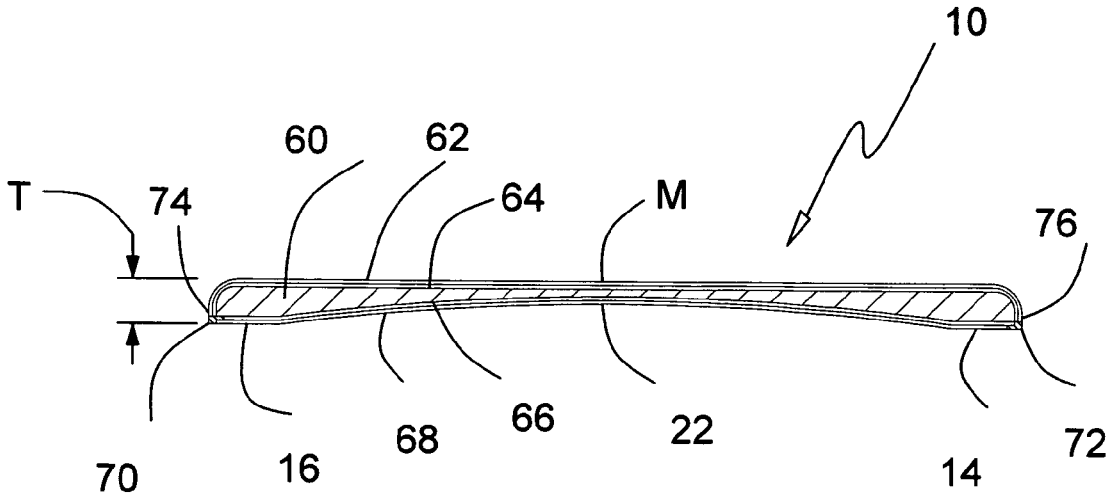
FIG. 5 is a cross-sectional end view of the snowboard illustrated in FIGS. 1, 2, 3, 4 and 5 taken along Section A—A shown in FIG. 1.

Referring now to FIG. 5 there is illustrated a first embodiment of a cross-section taken along section lines A—A of FIG. 1 of the snowboard 10 in accordance with the principles of the present invention. The snowboard 10 is comprised of various layers that are bonded together as by laminating through heat and pressure. The snowboard 10 is constructed of a core 60, typically comprised of wood, plastic, foam, a composite material or other materials known in the art. The core 60 is typically formed from a relatively lightweight material that reduces the overall weight of the snowboard 10. Various layers 62, 64, 66 and 68 are then laminated to the core 60 to provide the board with the desired stiffness and torsional rigidity characteristics, wear characteristics, as well as for the addition of graphics. Thus, the top layer 62 may be provided to include a top graphic and finish to the snowboard 10 while the layer 64 provides certain stiffness characteristics. Likewise, the first bottom layer 66 that is bonded to the core 60 is provided for stiffness and torsional rigidity, while the second bottom layer 68 is a material that is wear and scratch resistant, such as PTEX, that can glide along the snow without significant damage. Metal edges 70 and 72 flank the outer edges 74 and 76 of the snowboard 10 for edge protection and turning. In this particular example, the cross sectional thickness T of the snowboard 10 is non-uniform across its width. At the runner surfaces 14 and 16, the thickness T is greater than at a midpoint M of the snowboard 10. As such, in addition, the arcuate shape of the bottom surface 22 increases torsional and transverse stiffness of the board 10. The increased thickness of the board 10 proximate the runner surfaces 14 and 16 also increases the longitudinal stiffness of the board 10 without significantly increasing the weight of the board. Also, in this embodiment of the snowboard 10, the core 60 has a non-uniform cross-section in that its thickness also varies from being thicker to define the runner surfaces 14 and 16 to being thinner at the midpoint M to define the channel 22.

The runner surfaces 14 and 16 in combination with the channel 22 provide significantly improved performance characteristics to the snowboard 10. First, for downhill speed competitions, the snowboard performs significantly better than conventional snowboards because the stiffness of the board is increased without significantly increasing the weight of the snowboard 10. With a conventional snowboard where the cross-sectional thickness is substantially uniform across its width, the snowboard must either be made heavier in order to increase its stiffness or employ the use of significantly more expensive materials to increase the stiffness. Second, the use of raised surfaces 14 and 16 which form runner surfaces significantly decreases the drag of the snowboard 10 when the board is moving in a downhill direction. Thus, the snowboard performs more like a downhill skill in that the surface area of the bottom surface 22 that is bearing the load of the snowboard is significantly reduced and is placed primarily on the runner surfaces 14 and 16. Third, the use of the raised runner surfaces 14 and 16 in combination with the smooth contour of the bottom surface significantly improves the ease of transition between the left runner surface 14 to the right runner surface 16. More particularly, as the snowboard 10 is transitioned between the left edge 72 and the right edge 70, the weight of the snowboarder is easily transferred between the two and thus substantially reduces the chance of the snowboarder "catching an edge" thus significantly improving enjoyment of the sport and reducing possible injuries to snowboarders.

Figure 6:
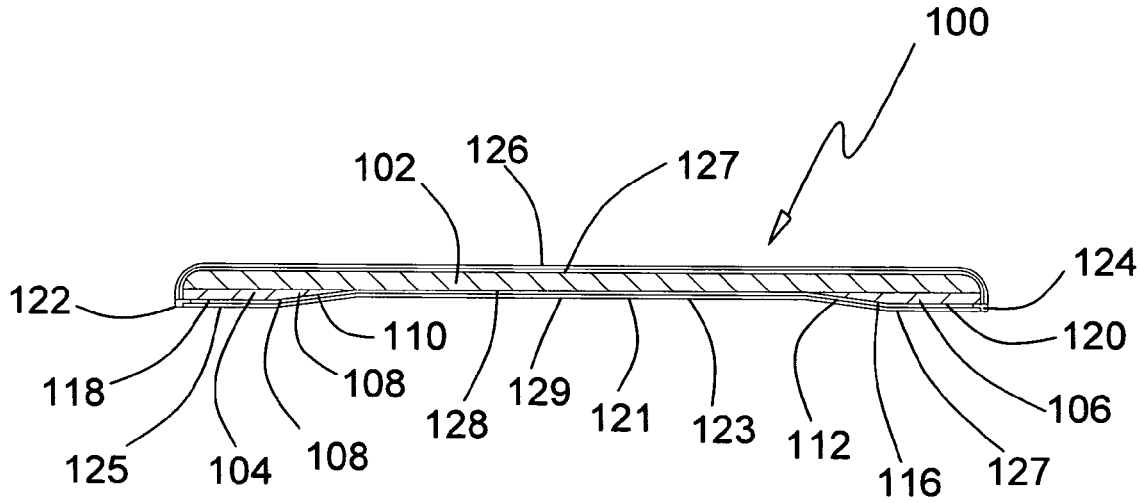
FIG. 6 is a cross-sectional end view of a second embodiment of a snowboard illustrated in accordance with the principles of the present invention.

FIG. 6 is another embodiment of a cross-sectional view of a snowboard, generally indicated at 100. The snowboard 100 is somewhat similar in configuration to that illustrated in FIG. 5 with one exception being that a core 102 is comprised of a relatively thin, relatively flat panel. Raised runners 104 and 106 formed from elongate strips are positioned adjacent the bottom surface 108 of the core 102. The runners 104 and 106 have inwardly tapered sides 110 and 112, respectively, that define tapered surfaces 114 and 116. The angle of the tapered surfaces 114 and 116 relative to the plane defined by the bottom surface 108 of the core 102 is such that a relatively gradual transition is formed between the bottom surface 108 of the core 102 and the runner surfaces 118 and 120 of runners 104 and 106, respectively.

The runners 104 and 106, being raised above the bottom surface 108 of the core define a longitudinally extending channel 121 along the bottom 123 of the snowboard. As such, the snowboard 100 is configured with an overall non-uniform cross-section that is thicker at the runners 104 and 106 and more narrow at the channel 121. This variation in cross-sectional thickness significantly increases the stiffness characteristics of the snowboard to prevent, for example, "chatter" when snowboarding at high speeds without a significant increase in the weight of the snowboard 100. Also, as previously discussed, the runner surfaces 125 and 127 defined by the bottom layer 129, carry the principle load of the snowboarder and thus decrease the surface area of the snowboard that is in weight bearing contact with the snow to decrease drag and increase downhill speed characteristics of the snowboard.

As with the embodiment illustrated in FIG. 5, metal edges 122 and 124 extend along the lower outer edge of each runner surface 118 and 120, respectively. In addition, various layers 126, 127, 128 and 129 are provided to cover the core 102 and runners 104 and 106 in order to add various features to the snowboard 100 as previously described.

Figure 7:
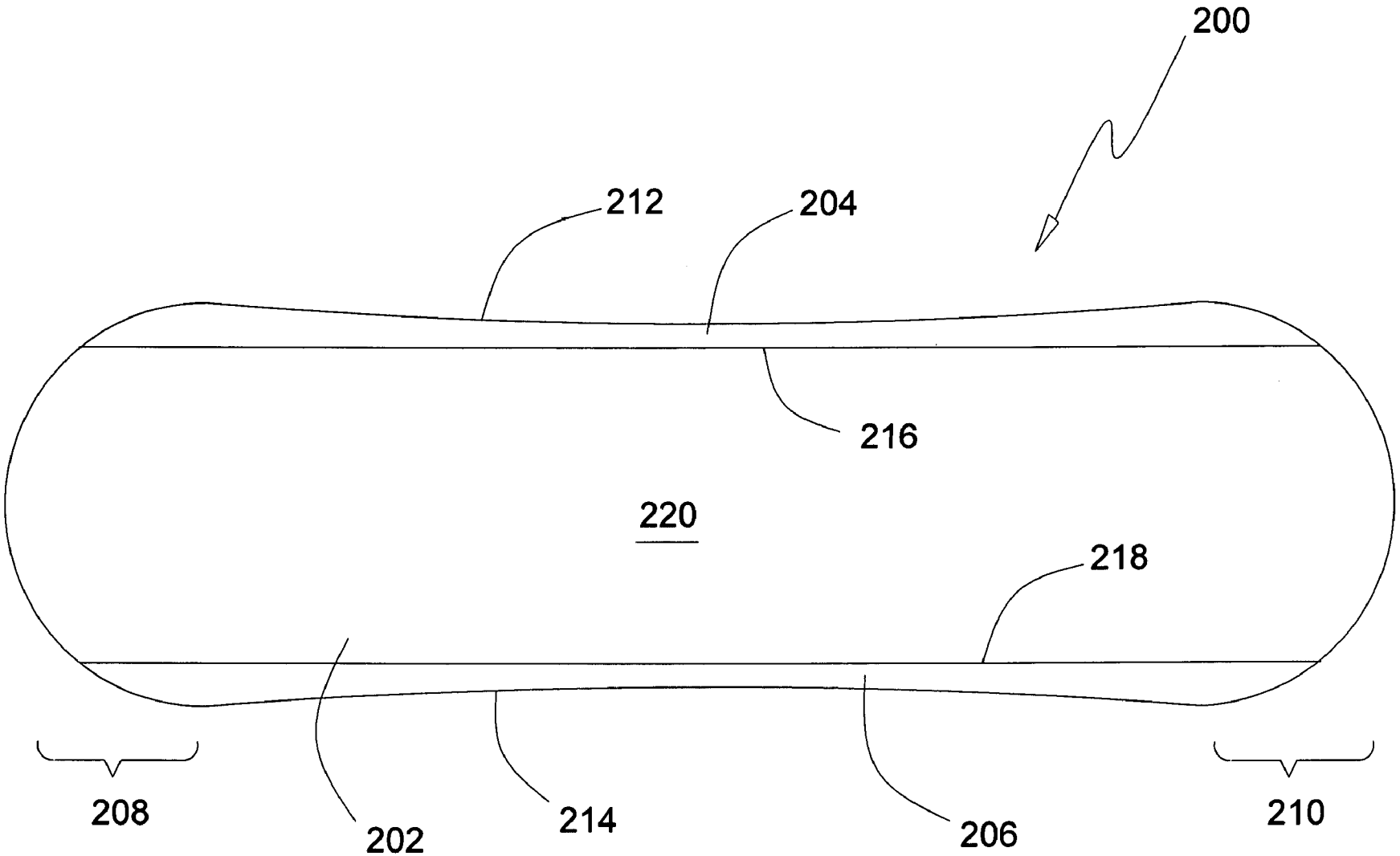
FIG. 7 is a bottom view of a third embodiment of a snowboard illustrated in accordance with the principles of the present invention.

Referring now to FIG. 7, there is shown another alternative embodiment of a snowboard 200 in accordance with the principles of the present invention. The bottom surface 202 of the snowboard 200 is provided with runners 204 and 206 that extend from a tip portion 208 to a tail portion 210. In this example, however, while the outer longitudinal edges 212 and 214 of the runners 204 and 206, respectively, have a gradual inward curvature, the inside surfaces 216 and 218 of the runner surfaces 204 and 206, respectively, are relatively linear along their length. Thus, the width of the runners 204 and 206 vary along their length between the tip and tail portions 208 and 210. As such, a longitudinally extending channel 220 defined by the runners 204 and 206 has a substantially consistent width along its entire length.

Figure 8:
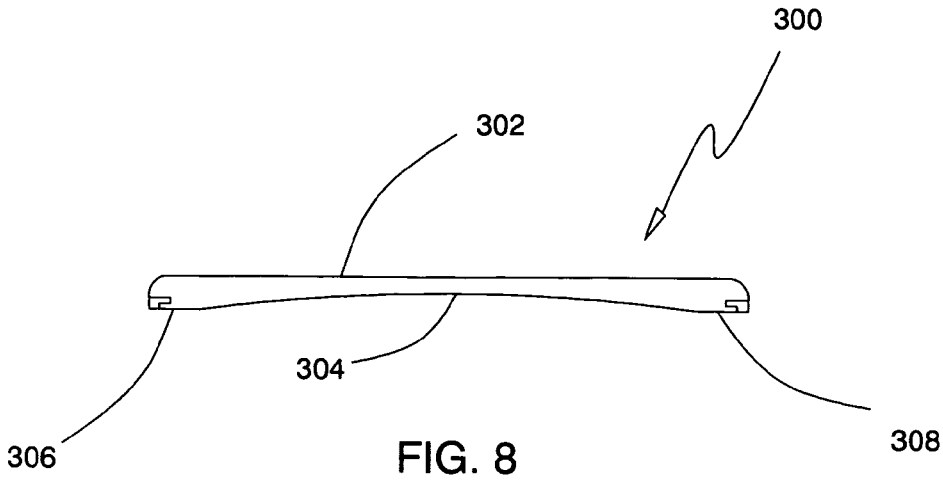
FIG. 8 is a cross-sectional end view of a fourth embodiment of a snowboard illustrated in accordance with the principles of the present invention.

FIGS. 8, 9, 10 and 11 illustrate various cross-sections of snowboards configured in accordance with the principles of the present invention. The snowboard, generally indicated at 300 as shown in FIG. 8 has a cross-sectional shape similar to that previous described with reference to FIG. 5. That is, while the top surface 302 is relatively flat, the bottom surface 304 is contoured between the runners 306 and 308. Thus, the snowboard 300 has a cross-sectional thickness that is greater at the runners 306 and 308 and that is thinner at its center.

Figure 9:
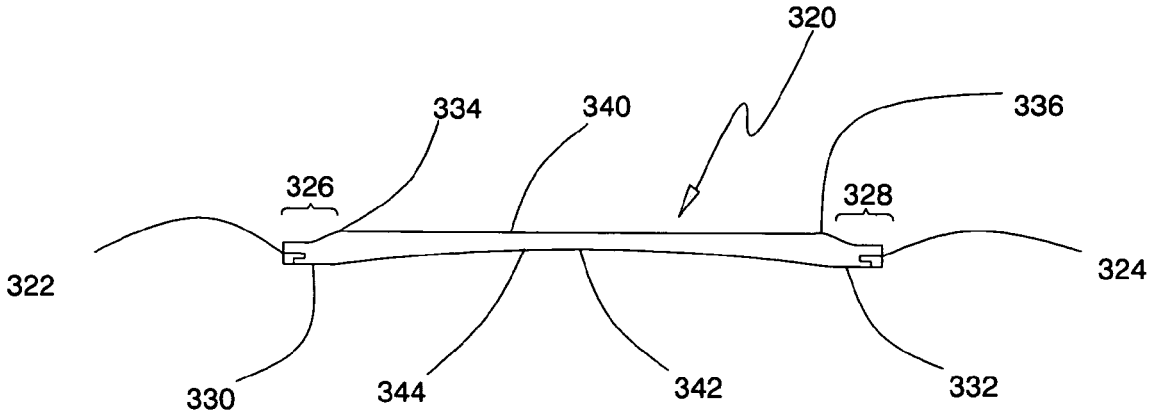
FIG. 9 is a cross-sectional end view of a fifth embodiment of a snowboard illustrated in accordance with the principles of the present invention.

In FIG. 9, however, in order to further decrease the weight of the snowboard, generally indicated at 320, the snowboard 320 proximate its outer edges 322 and 324 has thinned portions 326 and 328 at the runners 330 and 332, respectively. This thinning of the snowboard 320 along the outer edges 322 and 324, however, does not affect the stiffness of the board 320 as the snowboard 320 also has thicker portions 334 and 336 proximate the runners 330 and 332. Again, the top surface 340 of the snowboard 320 is relatively flat to allow mounting of conventional bindings thereto and the bottom surface 342 defines a longitudinally extending channel 344.

Figure 10:
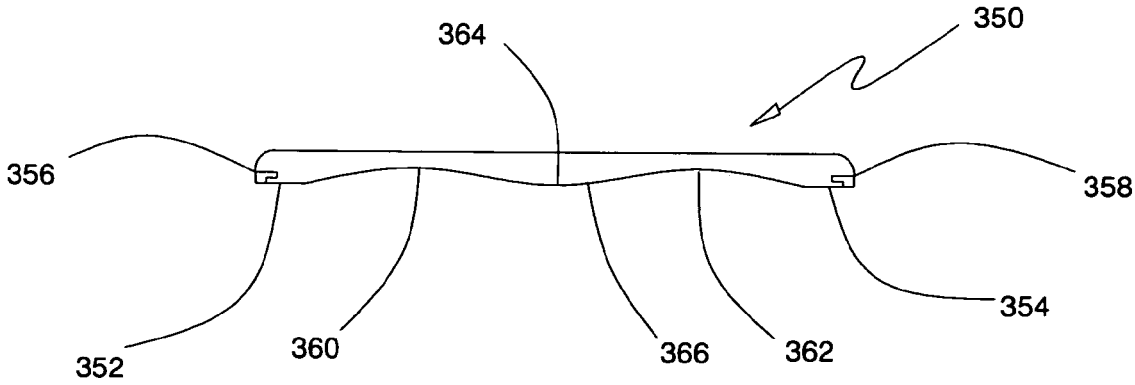
FIG. 10 is a cross-sectional end view of a sixth embodiment of a snowboard illustrated in accordance with the principles of the present invention.

FIG. 10 illustrates a snowboard, generally indicated at 350, in accordance with the principles of the present invention. The snowboard 350 includes runner surfaces 352 and 354 along the outer edges 356 and 358 but includes a pair of longitudinally extending channels 360 and 362 divided by a longitudinally extending central runner 364. The central runner 364 has a height that is substantially coplanar with the plane of the runners 352 and 354. The runners 352 and 354 and central runner 364 essentially form a wavy bottom surface 366 to the snowboard. Because the snowboard 350 is thicker along the central runner 364 than along the channels 360 and 362, the snowboard 350 is stiffened along its longitudinal central axis. Thus, by providing the channels 360 and 362 to a snowboard 350 having thickness at the center of the central runner similar to the thickness of a conventional snowboard, the weight of the snowboard 350 will be substantially less than that of a conventional snowboard of similar construction. That is, the amount of material removed from the snowboard when forming the channels 360 and 362 will significantly decrease the weight of the snowboard without affecting its stiffness properties. Indeed, the introduction of a contoured bottom surface 366 as illustrated is significantly more stiff than a snowboard of uniform cross-sectional thickness. As such, a snowboard configured in accordance with the principles of the present invention can be made lighter and thinner than a conventional snowboard while simultaneously increasing the stiffness and speed characteristics of the snowboard.

Of course, the exemplary embodiments of a snowboard illustrated herein are not limited to the specific designs shown in the drawings, and other designs obvious to persons skilled in the art may be used according to this invention. Thus, while the apparatus of the present invention has been described with reference to certain embodiments, it is contemplated that upon review of the present invention, those of skill in the art will appreciate that various modifications and combinations may be made to the present embodiments without departing from the spirit and scope of the invention as recited in the claims. The claims provided herein are intended to cover such modifications and combinations and all equivalents thereof. Reference herein to specific details of the illustrated embodiments is by way of example and not by way of limitation.

What is claimed is:

1. A snowboard, comprising:

an elongate board, having curved-up tip portion, a tail portion and a mid-portion extending between said tip portion and said tail portion, said mid-portion having a first side, a second side, a top surface and a bottom surface, said bottom surface defining first and second longitudinal outer edges along said first side and said second side, respectively; and first and second elongate runner surfaces integrally formed with said bottom surface of said elongate board and extending along a substantial length of said mid portion adjacent said first and second longitudinal outer edges, said first and second runner surfaces defining a longitudinally extending channel therein between along said bottom surface of said elongate board, said first and second elongate runner surfaces and said channel defining a smooth, continuous, uninterrupted surface between said first and second longitudinal edges, said elongate board having a cross-sectional thickness that is greater at said first and second elongate runner surfaces than at a center of said channel.

2. The snowboard of claim 1, wherein said cross-sectional thickness is gradually tapered between said first elongate runner surfaces and said center of said channel and between said second elongate runner surface and said channel.

3. The snowboard of claim 2, wherein said top surface of said elongate board is relatively flat.

4. The snowboard of claim 1, wherein said bottom surface along said first runner surface is co-planar with said bottom surface along said second runner surface.

5. The snowboard of claim 1, wherein said first and second runner surfaces have a substantially consistent width between said tip portion and said tail portion of said elongate board.

6. The snowboard of claim 5, wherein said board is wider proximate said tip portion and said tail portion than at a midpoint of said board with said first and second runner surfaces being curved between said tip portion and said tail portion.

7. The snowboard of claim 1, wherein a width of said first and second runner surfaces is approximately between 0.5 inches and 2.0 inches.

8. The snowboard of claim 1, wherein said first and second longitudinal edges form the only edging surfaces.

9. The snowboard of claim 1, wherein a depth of said longitudinally extending channel is approximately between 0.2 inches and 1.0 inches relative to said first and second runner surfaces.

10. A snowboard, comprising:

an elongate board, having a curved-up tip portion, a curved-up tail portion and a mid-portion extending between said tip portion and said tail portion, said mid-portion having a relatively flat top surface and a bottom surface, said bottom surface defining first and second outer edges; and first and second elongate runners integrally formed with said elongate board and extending along a substantial length of said mid portion to form said first and second outer edges, said first and second elongate runners defining a longitudinally extending channel therein between, said first and second elongate runners and said channel defining a smooth, continuous, uninterrupted surface between said first and second edges, said first and second elongate runners having bottom surfaces that are coplanar with each other and parallel to said top surface, said elongate board having a cross-sectional thickness that is greater at said first and second elongate runners than at a center of said channel.

11. The snowboard of claim 10, wherein said cross-sectional thickness of said elongate board above said first and second elongate runners is substantially uniform across a substantial width of each of said first and second elongate runners.

12. The snowboard of claim 10, wherein said cross-sectional thickness is gradually tapered between said first elongate runner and said center of said channel and between said second elongate runner and said channel.

13. The snowboard of claim 10, wherein said first and second runners have a substantially consistent width between said tip portion and said tail portion of said elongate board.

14. The snowboard of claim 13, wherein said board is wider proximate said tip portion and said tail portion than at a midpoint of said board with said first and second runners being curved between said tip portion and said tail portion.

15. The snowboard of claim 10, wherein a width of said first and second runners is approximately between 0.5 inches and 2.0 inches.

16. The snowboard of claim 10, wherein a depth of said longitudinally extending channel is approximately between 0.2 and 1.0 inches relative to said first and second runners.

17. The snowboard of claim 10, wherein said first and second longitudinal edges form the only edging surfaces.

18. A snowboard, comprising:

an elongate board, having curved-up tip portion, a tail portion and a mid-portion extending between said tip portion and said tail portion, said mid-portion having a first side, a second side, a top surface and a bottom surface, said bottom surface defining first and second longitudinal outer edges along said first side and said second side, respectively; and first and second elongate runner surfaces integrally formed with said bottom surface of said elongate board and extending along a substantial length of said mid portion adjacent said first and second longitudinal outer edges, said first and second runner surfaces defining a longitudinally extending channel therein between along said bottom surface of said elongate board, said first and second elongate runner surfaces and said channel defining a smooth, continuous, uninterrupted surface between said first and second longitudinal edges, and said first and second longitudinal edges forming the only edging surfaces.

19. The snowboard of claim 18, wherein said elongate board has a cross-sectional thickness that is greater at said first and second elongate runner surfaces than at a center of said channel.

20. The snowboard of claim 19, wherein said cross-sectional thickness is gradually tapered between said first elongate runner surfaces and said center of said channel and between said second elongate runner surface and said channel.

21. The snowboard of claim 18, wherein said first and second runner surfaces have a substantially consistent width between said tip portion and said tail portion of said elongate board.

22. The snowboard of claim 18, wherein said board is wider proximate said tip portion and said tail portion than at a midpoint of said board with said first and second runner surfaces being curved between said tip portion and said tail portion.

23. The snowboard of claim 18, wherein a width of said first and second runner surfaces is approximately between 0.5 inches and 2.0 inches.

24. The snowboard of claim 18, wherein a depth of said longitudinally extending channel is approximately between 0.2 inches and 1.0 inches relative to said first and second runner surfaces.

25. A snowboard, comprising:

an elongate board, having curved-up tip portion, a tail portion and a mid-portion extending between said tip portion and said tail portion, said mid-portion having a first side, a second side, a top surface and a bottom surface, said bottom surface defining first and second longitudinal outer edges along said first side and said second side, respectively; and first and second elongate runner surfaces integrally formed with said bottom surface of said elongate board and extending along a substantial length of said mid portion adjacent said first and second longitudinal outer edges, said first and second runner surfaces defining a longitudinally extending channel therein between along said bottom surface of said elongate board, said first and second elongate runner surfaces and said channel defining a smooth, continuous, uninterrupted surface between said first and second longitudinal edges, and said elongate board having a cross-sectional thickness that is gradually tapered between said first elongate runner surfaces and a center of said channel and between said second elongate runner surface and said center of said channel.

26. The snowboard of claim 25, wherein said elongate board has a cross-sectional thickness that is greater at said first and second elongate runner surfaces than at a center of said channel.

27. The snowboard of claim 25, wherein said top surface of said elongate board is relatively flat.

28. The snowboard of claim 25, wherein said bottom surface along said first runner surface is co-planar with said bottom surface along said second runner surface.

29. The snowboard of claim 25, wherein a width of said first and second runner surfaces is approximately between 0.5 inches and 2.0 inches.

30. The snowboard of claim 25, wherein said first and second longitudinal edges form the only edging surfaces.

31. A snowboard, comprising:

an elongate board, having a curved-up tip portion, a curved-up tail portion and a mid-portion extending between said tip portion and said tail portion, said mid-portion having a relatively flat top surface and a bottom surface, said bottom surface defining first and second outer edges; and first and second elongate runners integrally formed with said elongate board and extending along a substantial length of said mid portion to form said first and second outer edges, said first and second elongate runners defining a longitudinally extending channel therein between, said first and second elongate runners and said channel defining a smooth, continuous, uninterrupted surface between said first and second edges, said first and second elongate runners having bottom surfaces that are coplanar with each other and parallel to said top surface, and said first and second longitudinal edges forming the only edging surface.

32. The snowboard of claim 31, wherein said elongate board has a cross-sectional thickness that is greater at said first and second elongate runners than at a center of said channel.

33. The snowboard of claim 31, wherein a cross-sectional thickness of said elongate board above said first and second elongate runners is substantially uniform across a substantial width of each of said first and second elongate runners.

34. The snowboard of claim 31, wherein a cross-sectional thickness of said elongate board is gradually tapered between said first elongate runner and said center of said channel and between said second elongate runner and said channel.

35. The snowboard of claim 31, wherein said first and second runners have a substantially consistent width between said tip portion and said tail portion of said elongate board.

36. The snowboard of claim 31, wherein said first and second longitudinal edges form the only edging surfaces.

* * * * *